US012144368B2

(12) United States Patent
Kim et al.

(10) Patent No.: US 12,144,368 B2
(45) Date of Patent: Nov. 19, 2024

(54) EXTERNALLY HEATED AEROSOL GENERATION DEVICE AND CIGARETTE USED IN AEROSOL GENERATION DEVICE

(71) Applicant: KT&G CORPORATION, Daejeon (KR)

(72) Inventors: Soo Ho Kim, Cheongju-si (KR); Chang Jin Park, Sejong (KR); Man Seok Seo, Seoul (KR); Ki Jin Ahn, Daejeon (KR); Jong Yeol Kim, Sejong (KR); Jin Chul Yang, Sejong (KR)

(73) Assignee: KT&G CORPORATION, Daejeon (KR)

( * ) Notice: Subject to any disclaimer, the term of this patent is extended or adjusted under 35 U.S.C. 154(b) by 753 days.

(21) Appl. No.: 17/266,742

(22) PCT Filed: Nov. 15, 2019

(86) PCT No.: PCT/KR2019/015547
§ 371 (c)(1),
(2) Date: Feb. 8, 2021

(87) PCT Pub. No.: WO2020/105958
PCT Pub. Date: May 28, 2020

(65) Prior Publication Data

US 2021/0307379 A1 Oct. 7, 2021

(30) Foreign Application Priority Data

Nov. 19, 2018 (KR) ..... 10-2018-0142654

(51) Int. Cl.
*A24D 1/02* (2006.01)
*A24D 1/20* (2020.01)
*A24F 40/20* (2020.01)

(52) U.S. Cl.
CPC ..... *A24D 1/02* (2013.01); *A24D 1/20* (2020.01); *A24F 40/20* (2020.01)

(58) Field of Classification Search
CPC ..... A24D 1/02; A24D 1/20; A24F 40/20
USPC ..... 131/329
See application file for complete search history.

(56) References Cited

U.S. PATENT DOCUMENTS

| | | | |
|---|---|---|---|
| 3,586,005 | A | 6/1971 | Lippman, Jr. et al. |
| 4,991,606 | A | 2/1991 | Serrano et al. |
| 5,220,930 | A | 6/1993 | Gentry |
| 6,860,274 | B2 | 3/2005 | Matsufuji et al. |

(Continued)

FOREIGN PATENT DOCUMENTS

| | | | |
|---|---|---|---|
| CN | 1039710 | A | 2/1990 |
| CN | 1484500 | A | 3/2004 |

(Continued)

OTHER PUBLICATIONS

US 10,856,569 B2, 12/2020, Malgat et al. (withdrawn)

(Continued)

*Primary Examiner* — Gary F Paumen
(74) *Attorney, Agent, or Firm* — Sughrue Mion, PLLC

(57) ABSTRACT

The present disclosure provides an externally heated aerosol generation device and a cigarette that may provide a sufficient amount of atomization to allow a user to have a satisfactory smoking experience even during an initial puff because thermal energy is easily transferred to the cigarette.

11 Claims, 4 Drawing Sheets

(56) References Cited

U.S. PATENT DOCUMENTS

| | | | | |
|---|---|---|---|---|
| 7,017,586 | B2 | 3/2006 | Tsutsumi et al. | |
| 9,739,013 | B2 | 8/2017 | Kida et al. | |
| 9,775,377 | B2 | 10/2017 | Fritzsching et al. | |
| 10,849,357 | B2 * | 12/2020 | Roudier | A24D 1/22 |
| 10,993,473 | B2 | 5/2021 | Malgat et al. | |
| 2009/0301506 | A1 | 12/2009 | Kida et al. | |
| 2015/0111452 | A1 * | 4/2015 | Dugan | D01F 6/14 428/221 |
| 2015/0157052 | A1 | 6/2015 | Ademe et al. | |
| 2016/0143355 | A1 | 5/2016 | Borges et al. | |
| 2016/0309781 | A1 * | 10/2016 | Malgat | A24C 5/00 |
| 2016/0331031 | A1 * | 11/2016 | Malgat | A24D 1/20 |
| 2017/0055576 | A1 | 3/2017 | Beeson et al. | |
| 2017/0273353 | A1 * | 9/2017 | Gindrat | B41M 3/006 |
| 2019/0014813 | A1 * | 1/2019 | Carraro | A24D 1/025 |
| 2020/0359681 | A1 | 11/2020 | Han et al. | |
| 2021/0106051 | A1 | 4/2021 | Han et al. | |
| 2022/0087309 | A1 | 3/2022 | Han et al. | |

FOREIGN PATENT DOCUMENTS

| | | | |
|---|---|---|---|
| CN | 1672599 | A | 9/2005 |
| CN | 101605471 | B | 5/2011 |
| CN | 105324046 | A | 2/2016 |
| CN | 105495682 | A | 4/2016 |
| CN | 105744850 | A | 7/2016 |
| CN | 105939624 | A | 9/2016 |
| CN | 108135289 | A | 6/2018 |
| CN | 108366616 | A | 8/2018 |
| CN | 207836767 | U | 9/2018 |
| EP | 2 113 177 | A1 | 11/2009 |
| EP | 3187057 | A1 | 7/2017 |
| JP | 2016-538863 | A | 12/2016 |
| JP | 2017-502656 | A | 1/2017 |
| KR | 10-1082646 | B1 | 8/2009 |
| KR | 10-1812693 | B1 | 5/2015 |
| KR | 10-2016-0096590 | A | 8/2016 |
| KR | 10-2017-0015565 | A | 2/2017 |
| KR | 10-2017-0047225 | A | 5/2017 |
| KR | 10-2018-0092998 | A | 8/2018 |
| KR | 10-2018-0111460 | A | 10/2018 |
| WO | 2002/054891 | A1 | 7/2002 |
| WO | 2009/132828 | A1 | 11/2009 |
| WO | 2015/082653 | A1 | 6/2015 |
| WO | 2018/182322 | A1 | 10/2018 |

OTHER PUBLICATIONS

International Search Report for PCT/KR2019/015547 dated Feb. 26, 2020 [PCT/ISA/210].
Written Opinion for PCT/KR2019/015547 dated Feb. 26, 2020 [PCT/ISA/237].
Communication dated Jun. 29, 2022 from the Chinese Patent Office in Chinese Application No. 201980060638.5.
Extended European Search Report issued Dec. 22, 2021 in European Application No. 19887072.7.
Office Action issued Dec. 7, 2021 in Japanese Application No. 2020-552745.
An-da Gong, et al., "Influence of burn-supporting agents on cigarette paper and mainstream smoke", Applied Chemical Industry, Mar. 2011, vol. 40, No. 3 (1 page total).
Zhang Meiyun, "Papermaking Technology", Beijing: China Light Industry Press, Jan. 2014, ISBN 978-7-5019-9488-5 (24 pages total).
Cao Bangwei, et al., "Professional English in Pulp and Papermaking", China Light Industry Press, Jun. 2006, ISBN 7-5019-4349-X (10 pages total).
Chuai Chengzhi, "English for Polymer Engineering Speciality", Aug. 1999, ISBN 7-5019-2457-0 (9 pages total).
Zhou Dianming, et al., "Use and Maintenance of Plastic Calendering Machines", Beijing: Machinery Industry Press, 2010, ISBN 978-7-111-29994-3 (35 pages total).
Xiao-hui Lv, et al., "Pore in Paper and Its Structural Functions", China Pulp & Paper, 2016, vol. 35, No. 3, p. 64 (1 page total).
Feng Mingjie, et al. "Low temperature calendering technology for paper and board machines", Paper Science & Technology, 2016, vol. 35, No. 6, (2 pages total).
Wang Limian, et al., "Green Packaging of Cigarettes", Beijing: China Science and Technology Press, Jun. 2005, ISBN 7-5046-4063-8 (25 pages total).
"Tensile Strength", Baidu Baike, 2024 (7 pages total).
Bob Bonnet, et al., "Science Fair Projects: Physics", translated by Xu Jian and Li Xiaoping, Sterling Publishing Co Inc, Jul. 2001 (6 pages total).
Mn Shua, et al., "Printing and Packaging Materials", Cultural Development Press, Oct. 2017 (18 pages total).
Huang Cheng-chang, "Stiffness of Cardboard", China Papermaking, China Pulp & Paper, 1991, pp. 11-15 (5 pages total).
"Stiffness", definition from Baidu Baike, 2024 (2 pages total).
Suanyan Wang, et al., "Environmental vacuum metalized paper", Packaging Industry Standard of the People's Republic of China, BB/T0054-2010; published on Apr. 22, 2010 (15 pages total).
"Aluminum-plate transferred paper", Guangdong Province Local Standard DB44/T1045-2012, published on Jul. 4, 2012 (11 pages total).
Images of Laser Paper obtained from Baidu search, 2024 (1 pages total).
Zeng Zhengming, "Coating Quick Reference Manual" , Beijing: Machinery Industry Press, 2nd Edition, Mar. 2009 (14 pages total).
Yao Ying, et al., "Chemical Knowledge Dictionary", Student Reference Book Series, 006704, ISBN 7-80572-969-7, Sep. 1995 (13 pages total).
Tong Jungeng, "Fundamentals of Thermodynamics", Jun. 2009, ISBN 978-7-04-026137-0 (9 pages total).
Zhang Huailin, et al., "Cigarette Manufacturing Technology", 1997, ISBN 7-5019-2055-9 (17 pages total).
Notice of Acceptance of Invalidation Request issued Apr. 2, 2024 in Chinese Application No. 201980060638.5.

* cited by examiner

EXTERNALLY HEATED AEROSOL GENERATION DEVICE AND CIGARETTE USED IN AEROSOL GENERATION DEVICE

CROSS REFERENCE TO RELATED APPLICATIONS

This application is a National Stage of International Application No. PCT/KR2019/015547 filed Nov. 15, 2019, claiming priority based on Korean Patent Application No. 10-2018-0142654 filed Nov. 19, 2018.

TECHNICAL FIELD

The present disclosure relates to an externally heated aerosol generation device and a cigarette used in the aerosol generation device, and particularly, to an aerosol generation device that may generate an aerosol by heating a cigarette while a heater included in the aerosol generation device does not directly contact the cigarette, and a cigarette used in the aerosol generation device.

BACKGROUND ART

Recently, there has been increasing demand for alternative ways of overcoming the disadvantages of common cigarettes. For example, there is an increasing demand for a method of generating aerosol by heating an aerosol generating material in cigarettes, rather than by burning cigarettes. Accordingly, research into a heating-type cigarette or a heating-type aerosol generator has been actively conducted.

Among aerosol generation devices, there is an externally heated aerosol generation device for generating an aerosol that may be inhaled by a user by heating an inserted cigarette from the outside of the cigarette. The externally heated aerosol generation device is characterized in that, when a cigarette including an aerosol generating substrate is inserted, an aerosol is generated by applying heat to the cigarette from the outside without direct contact of a heater with the inserted cigarette, and has a limit in that a sufficient amount of atomization is not obtained during an initial puff period in which a user starts to puff the cigarette through the aerosol generation device, because thermal energy of the heater is not smoothly transferred to the cigarette.

DESCRIPTION OF EMBODIMENTS

Technical Problem

The present disclosure provides a cigarette that effectively receives thermal energy of a heater when the heater of an aerosol generation device is heated after the cigarette is inserted into an external heated aerosol generation device, and an aerosol generation device in which the cigarette is used.

Solution to Problem

According to an embodiment of the present disclosure, a cigarette that generates an aerosol from a medium included in a medium portion through heating includes a medium portion wrapper wrapped around the medium portion, and an outer cover that is collectively wrapped around the medium portion wrapped by the medium portion wrapper and elements other than the medium portion, wherein the medium portion wrapper is produced by work processing of increasing efficiency of thermal energy transferred to the medium portion by more than a preset value.

According to another embodiment of the present embodiment, an aerosol generation device for generating an aerosol through the cigarette according to the embodiment may be provided to a user.

Advantageous Effects of Disclosure

According to the present disclosure, there are provided an aerosol generation device capable of providing a sufficient amount of atomization to a user that uses the aerosol generation device even during an initial puff, and a cigarette used in the aerosol generation device.

BEST MODE

Figure 1:
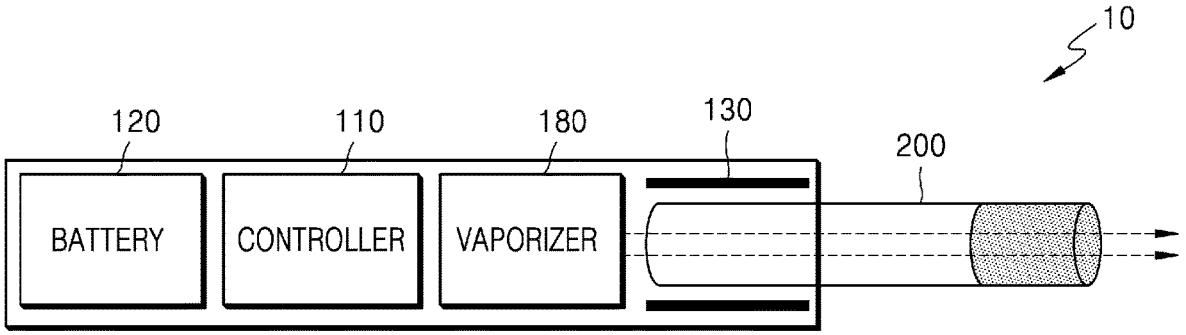
FIGS. 1 and 2 are diagrams illustrating examples in which a cigarette is inserted into an aerosol generation device.

According to an embodiment of the present disclosure, a cigarette that generates an aerosol from a medium included in a medium portion through heating includes a medium portion wrapper wrapped around the medium portion, and an outer cover that is collectively wrapped around the medium portion wrapped by the medium portion wrapper and elements other than the medium portion, wherein the medium portion wrapper is produced by work processing of increasing efficiency of thermal energy transferred to the medium portion by more than a preset value.

In the cigarette, the medium portion wrapper may be coated with a material having a thermal conductivity of a preset value or more.

In the cigarette, the medium portion wrapper may include an internally added material that has a thermal conductivity of a preset value or more.

In the cigarette, the medium portion wrapper and the outer cover may be coated with a material having a thermal conductivity of a preset value or more.

In the cigarette, the medium portion wrapper and the outer cover may include an internally added material that has a thermal conductivity of a preset value or more.

In the cigarette, the outer cover may be MFW base paper coated with a material having a thermal conductivity of a preset value or more.

In the cigarette, the medium portion wrapper may be pearl-coated with a material having a thermal conductivity of a preset value or more after calendering is performed.

In the cigarette, the material may be aluminum foil.

In the cigarette, the medium portion wrapper may be a wrapper subjected to calendaring after being coated with a material having a thermal conductivity of a preset value or more.

In the cigarette, the material may be any one of sodium citrate and potassium citrate.

In the cigarette, the medium portion wrapper may be obtained by changing at least one of tensile strength, smoothness, and stiffness of a normal porous wrapper by a preset ratio or more through work processing.

According to another embodiment of the present embodiment, an aerosol generation device for generating an aerosol through the cigarette according to the embodiment may be provided to a user.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

The attached drawings for illustrating one or more embodiments are referred to in order to gain a sufficient understanding, the merits thereof, and the objectives accomplished by the implementation. The disclosure may, however, be embodied in many different forms and should not be construed as being limited to the embodiments set forth herein.

Hereinafter, embodiments of the present disclosure will be described in detail with reference to the drawings.

Figure 2:
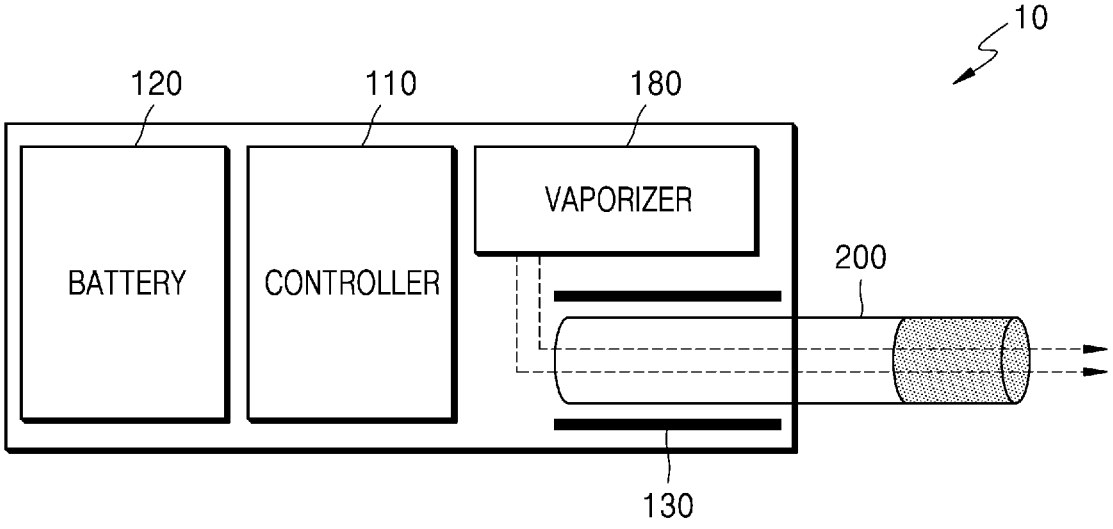

FIGS. 1 and 2 are diagrams showing examples in which a cigarette is inserted into an aerosol generating device.

Referring to FIG. 1 and FIG. 2, an aerosol generator 10 includes a battery 120, a controller 110, a heater 130 and vaporizer 180. Also, a cigarette 200 may be inserted into an inner space of the aerosol generator 10.

The elements related to the embodiment are illustrated in the aerosol generator 10 of FIGS. 1 to 2. Therefore, one of ordinary skill in the art would appreciate that other universal elements than the elements shown in FIGS. 1 to 2 may be further included in the aerosol generator 10.

Also, FIGS. 1 and 2 show that the aerosol generator 10 includes the heater 130, but if necessary, the heater 130 may be omitted.

In FIG. 1, the battery 120, the controller 110, the heater 130 and the vaporizer 180 are arranged in a row. Also, FIG. 2 shows that the vaporizer 180 and the heater 130 are arranged in parallel with each other. However, an internal structure of the aerosol generator 10 is not limited to the examples shown in FIGS. 1 to 2. That is, according to a design of the aerosol generator 10, the arrangement of the battery 120, the controller 110, the heater 130, and the vaporizer 180 may be changed.

When the cigarette 200 is inserted into the aerosol generator 10, the aerosol generator 10 operates the heater 130 and/or the vaporizer 180 to generate aerosol from the cigarette 200 and/or the vaporizer 180. The aerosol generated by the vaporizer 180 passes through the cigarette 200 and is delivered to the user. A description of the vaporizer 180 will be described in more detail below.

The battery 120 supplies the electric power used to operate the aerosol generator 10. For example, the battery 120 may supply power for heating the heater 130 or the vaporizer 180 and supply power for operating the controller 110. In addition, the battery 120 may supply power for operating a display, a sensor, a motor, and the like installed in the aerosol generator 10.

The controller 110 controls the overall operation of the aerosol generator 10. In detail, the controller 110 may control operations of other elements included in the aerosol generator 10, as well as the battery 120, the heater 130, and the vaporizer 180. Also, the controller 110 may check the status of each component in the aerosol generator 10 to determine whether the aerosol generator 10 is in an operable state.

The controller 110 includes at least one processor. A processor can be implemented as an array of a plurality of logic gates or can be implemented as a combination of a general-purpose microprocessor and a memory in which a program executable in the microprocessor is stored. It will be understood by one of ordinary skill in the art that the present disclosure may be implemented in other forms of hardware.

The heater 130 may be heated by the electric power supplied from the battery 120. For example, when the cigarette 200 is inserted in the aerosol generator 10, the heater 130 may be located outside the cigarette 200 Therefore, the heated heater 130 may raise the temperature of an aerosol generating material in the cigarette 200.

The heater 130 may be an electro-resistive heater. For example, the heater 130 includes an electrically conductive track, and the heater 130 may be heated as a current flows through the electrically conductive track. However, the heater 130 is not limited to the above example, and any type of heater may be used provided that the heater is heated to a desired temperature. Here, the desired temperature may be set in advance on the aerosol generator 10, or may be set by a user.

In addition, in another example, the heater 130 may include an induction heating-type heater. In detail, the heater 130 may include an electrically conductive coil for heating the cigarette 200 in an induction heating method, and the cigarette may include a susceptor that may be heated by the induction heating-type heater.

Referring to FIGS. 1 and 2, the heater 130 is shown to be disposed outside the cigarette 200, but is not limited thereto. For example, the heater may include a tubular-type heating element, a plate-type heating element, a needle-type heating element, or a rod-type heating element, and may heat the inside or outside of the cigarette 200 according to the shape of the heating element.

Also, there may be a plurality of heaters 130 in the aerosol generator 10. Here, the plurality of heaters 130 may be arranged to be inserted into the cigarette 200 or on the outside of the cigarette 200. Also, some of the plurality of heaters 130 may be arranged to be inserted into the cigarette 200 and the other may be arranged on the outside of the cigarette 200. In addition, the shape of the heater 130 is not limited to the example shown in FIGS. 1 to 2, but may be manufactured in various shapes.

The vaporizer 180 may generate aerosol by heating a liquid composition, and the generated aerosol may be delivered to the user after passing through the cigarette 200. In other words, the aerosol generated by the vaporizer 180 may move along an air flow passage of the aerosol generator 10, and the air flow passage may be configured for the aerosol generated by the vaporizer 180 to be delivered to the user through the cigarette 200.

For example, the vaporizer 180 may include a liquid storage unit, a liquid delivering unit, and a heating element, but is not limited thereto. For example, the liquid storage unit, the liquid delivering unit, and the heating element may be included in the aerosol generator 10 as independent modules.

The liquid storage may store a liquid composition. For example, the liquid composition may be a liquid including a tobacco-containing material including a volatile tobacco flavor component, or a liquid including a non-tobacco material. The liquid storage unit may be detachably attached to the vaporizer 180 or may be integrally manufactured with the vaporizer 180.

For example, the liquid composition may include water, solvents, ethanol, plant extracts, flavorings, flavoring agents, or vitamin mixtures. The flavoring may include, but is not limited to, menthol, peppermint, spearmint oil, various fruit flavoring ingredients, etc. The flavoring agent may include components that may provide the user with various flavors or tastes. Vitamin mixtures may be a mixture of at least one of vitamin A, vitamin B, vitamin C, and vitamin E, but are not limited thereto. Also, the liquid composition may include an aerosol former such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivering unit. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 180 may be referred to as a cartomizer or an atomizer, but is not limited thereto.

In addition, the aerosol generator 10 may further include universal elements, in addition to the battery 120, the controller 110, the heater 130, and the vaporizer 180. For example, the aerosol generator 10 may include a display capable of outputting visual information and/or a motor for outputting tactile information. In addition, the aerosol generator 10 may include at least one sensor (a puff sensor, a temperature sensor, a cigarette insertion sensor, etc.) Also, the aerosol generator 10 may be manufactured to have a structure, in which external air may be introduced or internal air may be discharged even in a state where the cigarette 200 is inserted.

Although not shown in FIGS. 1 to 2, the aerosol generator 10 may configure a system with an additional cradle. For example, the cradle may be used to charge the battery 120 of the aerosol generator 10. Alternatively, the heater 130 may be heated in a state in which the cradle and the aerosol generator 10 are coupled to each other.

The cigarette 200 may be similar to a typical burning cigarette. For example, the cigarette 200 may include a first portion containing an aerosol generating material and a second portion including a filter and the like. Alternatively, the second portion of the cigarette 200 may also include the aerosol generating material. For example, an aerosol generating material made in the form of granules or capsules may be inserted into the second portion.

The entire first portion may be inserted into the aerosol generator 10, and the second portion may be exposed to the outside. Alternatively, only a portion of the first portion may be inserted into the aerosol generator 10 or the entire first portion and a portion of the second portion may be inserted into the aerosol generator 10. The user may puff aerosol while holding the second portion by the mouth of the user. At this time, the aerosol is generated by as the outside air passes through the first portion, and the generated aerosol passes through the second portion and is delivered to a user's mouth.

For example, the outside air may be introduced through at least one air passage formed in the aerosol generator 10. For example, the opening and closing of the air passage formed in the aerosol generator 10 and/or the size of the air passage may be adjusted by a user. Accordingly, the amount of smoke and a smoking impression may be adjusted by the user. In another example, the outside air may be introduced into the cigarette 200 through at least one hole formed in a surface of the cigarette 200.

Hereinafter, an example of the cigarette 200 will be described with reference to FIG. 3.

Figure 3:
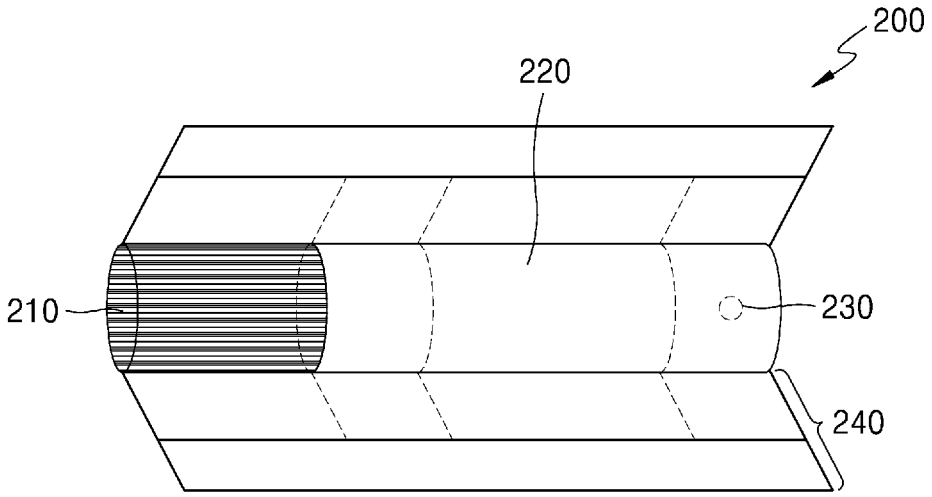
FIG. 3 is a view illustrating an example of a cigarette.

FIG. 3 is a drawing illustrating an example of a cigarette.

Referring to FIG. 3, the cigarette 200 includes a tobacco rod 210 and a filter rod 220. The first portion described above with reference to FIGS. 1 to 2 include the tobacco rod 210 and the second portion includes the filter rod 220.

In FIG. 3, the filter rod 220 is shown as a single segment, but is not limited thereto. In other words, the filter rod 220 may include a plurality of segments. For example, the filter rod 220 may include a first segment for cooling down the aerosol and a second segment for filtering a predetermined component included in the aerosol. Also, if necessary, the filter rod 220 may further include at least one segment performing another function.

The cigarette 200 may be packaged by at least one wrapper 240. The wrapper 240 may include at least one hole through which the outside air is introduced or inside air is discharged. For example, the cigarette 200 may be packaged by one wrapper 240. In another example, the cigarette 200 may be packaged by two or more wrappers 240. For example, the tobacco rod 210 may be packaged by a first wrapper and the filter rod 220 may be packaged by a second wrapper. In addition, the tobacco rod 210 and the filter 220 are respectively packaged by single wrappers, and then, the cigarette 200 may be entirely re-packaged by a third wrapper. When each of the tobacco rod 210 and the filter rod 220 includes a plurality of segments, each of the segments may be packaged by a single wrapper. In addition, the cigarette 200, in which the segments respectively packaged by the single wrappers are coupled to one another, may be re-packaged by another wrapper.

The tobacco rod 210 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. In addition, the tobacco rod 210 may include other additive materials like a flavoring agent, a wetting agent, and/or an organic acid. Also, a flavoring liquid such as menthol, humectant, etc. may be added to the tobacco rod 210 by being sprayed to the tobacco rod 210.

The tobacco rod 210 may be manufactured variously. For example, the tobacco rod 210 may be fabricated as a sheet or a strand. Also, the tobacco rod 210 may be fabricated by tobacco leaves that are obtained by fine-cutting a tobacco sheet. Also, the tobacco rod 210 may be surrounded by a heat conducting material. For example, the heat-conducting material may be, but is not limited to, a metal foil such as aluminum foil. For example, the heat conducting material surrounding the tobacco rod 210 may improve a thermal conductivity applied to the tobacco rod by evenly dispersing the heat transferred to the tobacco rod 210, and thus, improving tobacco taste. Also, the heat conducting material surrounding the tobacco rod 210 may function as a susceptor that is heated by an inducting heating-type heater. Although not shown in the drawings, the tobacco rod 210 may further include a susceptor, in addition to the heat conducting material surrounding the outside thereof.

The filter rod 220 may be a cellulose acetate filter. In addition, the filter rod 220 is not limited to a particular shape. For example, the filter rod 220 may be a cylinder-type rod or a tube-type rod including a cavity therein. Also, the filter rod 220 may be a recess type rod. When the filter rod 220 includes a plurality of segments, at least one of the plurality of segments may have a different shape from the others.

The filter rod 220 may be manufactured to generate flavor. For example, a flavoring liquid may be sprayed to the filter rod 220 or separate fibers on which the flavoring liquid is applied may be inserted in the filter rod 220.

Also, the filter rod 220 may include at least one capsule 230. Here, the capsule 230 may generate flavor or may generate aerosol. For example, the capsule 230 may have a structure, in which a liquid containing a flavoring material is wrapped with a film. The capsule 230 may have a circular or cylindrical shape, but is not limited thereto.

When the filter rod 220 includes a segment for cooling down the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above examples, and may include any material provided that a function of cooling down the aerosol is implemented.

Although not shown in FIG. 3, the cigarette 200 according to the embodiment may further include a front-end filter. The front-end filter is at a side facing the filter rod 220, in the tobacco rod 210. The front-end filter may prevent the tobacco rod 210 from escaping to the outside and may prevent the liquefied aerosol from flowing to the aerosol generator 10 (see FIGS. 1 to 2) from the tobacco rod 210 during smoking.

Figure 4:
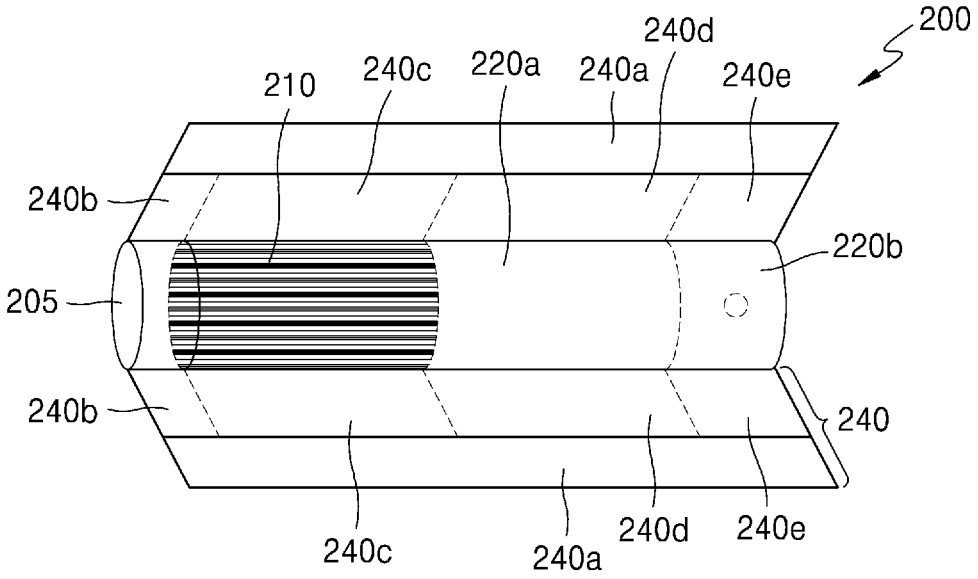
FIG. 4 is a view illustrating another example of a cigarette.

FIG. 4 is a view illustrating another example of a cigarette.

Referring to FIG. 4, it can be seen that the cigarette 200 has a form in which a cross tube 205, the tobacco rod 210, a tube 220*a*, and a filter 220*b* are wrapped by the final wrapper 240. In FIG. 4, the wrapper includes individual wrappers that are individually wrapped around the cross tube 205, the tobacco rod 210, the tube 220*a*, and the filter 220*b*, and a final wrapper that is collectively wrapped around the cross tube 205, the tobacco rod 210, the tube 220*a*, and the filter 220*b*.

The first portion described above with reference to FIGS. 1 and 2 includes the cross tube 205 and the tobacco rod 210, and the second portion includes the filter rod 220. For the sake of convenient description, the following description will be made with reference to FIGS. 1 and 2, and description overlapping with the description made with reference to FIG. 3 will be omitted.

The cross tube 205 refers to a cross-shaped tube connected to the tobacco rod 210.

The tobacco rod 210 includes an aerosol generating substrate that generates an aerosol by being heated by the heater 130 of the aerosol generation device 10.

The tube 220*a* performs a function of transferring an aerosol generated when an aerosol generating substrate of the tobacco rod 210 is heated by receiving the sufficient amount of energy from the heater 130 to the filter 220*b*. The tube 220*a* is manufactured in a manner in which triacetin (TA) which a plasticizer is added to a cellulose acetate tow by more than a certain amount to form a circle, and not only is different in shape but also has a difference in arrangement in that the tobacco rod 210 and the filter 220*b* are connected to each other, as compared with the cross tube 205.

When the aerosol generated by the tobacco rod 210 is transferred through the tube 220*a*, the filter 220*b* performs a function of allowing a user to puff the aerosol filtered by the filter 220*b* by passing the aerosol therethrough. The filter 220*b* may include a cellulose acetate filter manufactured based on a cellulose acetate tow.

The final wrapper 240 is paper that is wrapped around the cross tube 205, the tobacco rod 210, the tube 220*a*, and the filter 220*b*, and may include all of a cross tube wrapper 240*b*, a tobacco rod wrapper 240*c*, a tube wrapper 240*d*, and a filter wrapper 240*e*. The final wrapper 240 may further include an outer cover 240*a* that is collectively wrapped around the cross tube wrapper 240*b*, the tobacco rod wrapper 240*c*, the tube wrapper 240*d*, and the filter wrapper 240*e*.

In FIG. 4, the cross tube wrapper 240*b* is wrapped by an aluminum wrapper, the tube 220*a* is wrapped by an MFW or 24K wrapper, and the filter 220*b* is wrapped by an oilresistant hard wrapper or a lamination of a poly lactic acid (PLA) material. The tobacco rod wrapper 240*c* and the final wrapper 240 will be described in more detail below.

The tobacco rod wrapper 240*c* is wrapped around the tobacco rod 210 and may be coated with a thermal conductivity enhancement material to maximize efficiency of thermal energy transferred by the heater 130. For example, the tobacco rod wrapper 240*c* may be manufactured in a manner in which a general wrapper or heterotype base paper is coated with at least one of silver foil (Ag), aluminum foil (Al), copper foil (Cu), carbon paper, filler, ceramic (AlN, $Al_2O_3$), silicon carbide, sodium citrate (Na citrate), potassium citrate (K citrate), aramid fiber, nano cellulose, mineral paper, glassine paper, single-walled carbon nanotube (SWNT). A general wrapper refers to a wrapper applied to widely known cigarettes and refers to a porous wrapper made of a proven material that has both paper manufacturing workability and a thermal conductivity exceeding a certain value through a water paper test.

In addition, in the present disclosure, the final wrapper 240 may be manufactured in a manner in which an MFW (a kind of steriled paper) base paper is coated with at least one of filler, ceramic, silicon carbide, sodium citrate, potassium citrate, aramid fiber, nano cellulose, and SWNT among various materials coating the tobacco rod wrapper 240*c*.

The heater 130 included in the externally heated aerosol generation device 10 described in FIGS. 1 and 2 is a target controlled by the controller 110, and heats the aerosol generating substrate included in the tobacco rod 210 to generate an aerosol, and at this time, thermal energy transferred to the tobacco rod 210 is composed of a ratio of 75% by radiant heat, 15% by convective heat, and 10% by conductive heat. The ratio between the radiant heat, the convective heat, and the conductive heat constituting the thermal energy transferred to the tobacco rod 210 may be different depending on the embodiment.

In the present disclosure, in order to overcome the difficulty in quickly generating an aerosol because thermal energy may not be transferred with the heater 130 in direct contact with an aerosol generating substrate, the tobacco rod wrapper 240*c* and the final wrapper 240 are coated with a thermal conductivity enhancement material to prompt an efficient transfer of the thermal energy to the aerosol generating substrate of the tobacco rod 210, and thus, a sufficient amount of aerosol may be provided to a user even during an initial puff before the heater 130 is sufficiently heated.

Depending on the embodiment, only one of the tobacco rod wrapper 240*c* and the final wrapper 240 may also be coated with a thermal conductivity enhancement material, and the present disclosure may also be implemented in a manner in which the tobacco rod wrapper 240*c* or the final wrapper 240 is coated with organic metal, inorganic metal, fiber, or polymer material which has a thermal conductivity of a preset value, as well as the above-described examples.

Hereinafter, processes of manufacturing the tobacco rod wrapper 240*c* and the final wrapper 240 according to the present disclosure, and properties of the tobacco rod wrapper 240*c* and the final wrapper 240 manufactured according to the processes will be described.

The tobacco rod wrapper 240*c* may be manufactured by coating a general wrapper or a heterotype base paper with the above-described thermal conductivity enhancement material and then slitting the coated wrapper or paper. As an example of a method of coating a general wrapper or heterotype base paper with a thermal conductivity enhancement material, a pearl coating method may be used. In addition, as an example of a slitting method, a width of slitting may be 24.5 mm, and the width of slitting may change depending on the embodiment.

As an example of a method of manufacturing the tobacco rod wrapper 240*c*, a general wrapper subjected to calendering may be used as a wrapper serving as a base of the tobacco rod wrapper 240*c*.

TABLE 1

| | | 26.5 gsm general wrapper | | |
|---|---|---|---|---|
| Classification | Unit | base paper | after calendering | |
| basis weight | $g/m^2$ | 26.5 | 26.4 | |
| thickness | μm | 45.1 | 34.5 | 23.5% reduction |
| Density | $g/cm^3$ | 0.59 | 0.77 | |
| Bulk | $cm^3/g$ | 1.70 | 1.31 | |
| tensile strength (MD) | kgf/15 mm | 5.81 | 5.67 | |
| smoothness (SS) | sec | 28 | 200 | |
| smoothness (RS) | | 8 | 150 | |
| Stiffness | $cm^3$ | 16 | 15 | |

Table 1 shows an example of physical properties of a general wrapper before being pearl-coated with a thermal conductivity enhancement material. Referring to Table 1, it can be seen that a thickness of a general wrapper not pearl-coated with a thermal conductivity enhancement material is reduced by 23.5% as compared to a state of base paper and other physical properties are changed after calendaring is performed. The tobacco rod wrapper 240*c* may be manufactured by a method of pearl coating a calendered general wrapper with a thermal conductivity enhancement material. As an optional embodiment, the tobacco rod wrapper 240*c* may be manufactured by performing calendering after being coated with a thermal conductivity enhancement material is performed on the basis of any one of a general wrapper, heterotype base paper, and MFW base paper. According to the optional embodiment, in order to increase a thermal energy transfer rate of the cigarette 200 to an aerosol generating substrate, a wrapper first coated with a thermal conductivity enhancement material is subjected to calendering, not the wrapper subjected to calendering.

TABLE 2

| | | 26.5 gsm general wrapper | | 35 gsm heterotype base paper | | 60 gsm MFW base paper | |
|---|---|---|---|---|---|---|---|
| classification | unit | base paper | final | base paper | final | base paper | final |
| basis weight | $g/m^2$ | 26.8 | 27.6 | 35.2 | 35.9 | 60.5 | 61.6 |
| amount of coating | | 2.24 | | 1.99 | | 1.98 | |
| thickness | μm | 45 | 34.2 | 43 | 38.3 | 68.7 | 69.2 |
| Density | $g/cm^3$ | 0.6 | 0.81 | 0.82 | 0.94 | 0.88 | 0.89 |
| Bulk | $cm^3/g$ | 1.68 | 1.24 | 1.22 | 1.07 | 1.14 | 1.12 |
| tensile strength (MD) | kgf/15 mm | 6.23 | 5.12 | 7.55 | 7.6 | 9.6 | 9.85 |
| tensile strength (CD) | | 1.08 | 1.32 | 1.9 | 1.92 | 2.58 | 2.59 |
| smoothness (SS) | sec | 25 | 145 | 100 | 225 | 260 | 150 |
| smoothness (RS) | | 8 | 110 | 80 | 175 | 75 | 40 |
| Stiffness | $cm^3$ | — | 16 | — | 26.9 | — | 66.4 |

Table 2 shows comparison of physical properties before and after various wrappers are coated with potassium citrate which is a thermal conductivity enhancement material. Referring to Table 2, it can be seen that, depending on a material of a wrapper used as a base, tensile strength, smoothness, and stiffness of the tobacco rod wrapper 240*c* are changed by more than a preset ratio by different coating amount from 1.98% to 2.24%. Here, the preset ratio means a ratio value calculated by experimental and mathematical calculations to increase thermal energy transferred to an aerosol generating substrate by a certain value or more.

TABLE 3

| | | 26.5 gsm general wrapper | | 35 gsm heterotype base paper | | 60 gsm MFW base paper | |
|---|---|---|---|---|---|---|---|
| classification | unit | base paper | final | base paper | final | base paper | final |
| basis weight | $g/m^2$ | 26.6 | 27.2 | 34.6 | 35.6 | 60.2 | 61.2 |
| amount of coating | | 1.88 | | 2.31 | | 1.83 | |
| thickness | μm | 44.7 | 32.2 | 42.8 | 38 | 67.4 | 69.2 |
| Density | $g/cm^3$ | 0.6 | 0.84 | 0.81 | 0.94 | 0.89 | 0.88 |
| Bulk | $cm^3/g$ | 1.68 | 1.18 | 1.23 | 1.07 | 1.12 | 1.13 |
| tensile strength (MD) | kgf/15 mm | 6.14 | 5.63 | 7.92 | 7.88 | 9.88 | 9.79 |
| tensile strength (CD) | | 1.32 | 1.27 | 1.84 | 1.58 | 2.71 | 2.62 |
| smoothness (SS) | sec | 30 | 170 | 150 | 265 | 280 | 160 |
| smoothness (RS) | | 10 | 135 | 70 | 165 | 80 | 40 |
| Stiffness | $cm^3$ | — | 16.4 | — | 27.4 | — | 63.3 |

Table 3 shows comparison of physical properties before and after various wrappers are coated with sodium citrate which is a thermal conductivity enhancement material. Referring to Table 3, it can be seen that, depending on a material of a wrapper used as a base, tensile strength, smoothness, and stiffness of the tobacco rod wrapper 240*c* are changed by more than a preset ratio by applying different coating amounts from 1.83% to 2.31%. Here, the preset ratio means a ratio value calculated by experimental and mathematical calculations to increase thermal energy transferred to an aerosol generating substrate by a certain value or more. As shown in Table 2 and Table 3, a wrapper coated with potassium citrate or sodium citrate may be manufactured as the tobacco rod wrapper 240*c* through calendering. In addition, potassium citrate and sodium citrate described through Table 2 and Table 3 are examples of a thermal conductivity enhancement material, and other thermal conductivity enhancement materials other than the potassium citrate and the sodium citrate may be applied depending on the embodiment.

TABLE 4

| items | amount of smoke | heat sensation of oral region | heat sensation of main stream smoke | smoking intensity | irritation | degree of flavor |
|---|---|---|---|---|---|---|
| general wrapper (control plot) | 4.5 | 3.7 | 3.6 | 2.8 | 3.0 | 3.1 |
| general wrapper (Na) | 4.8 | 3.7 | 3.8 | 3.1 | 3.2 | 3.5 |
| general wrapper (K) | 4.9 | 3.8 | 3.8 | 3.1 | 3.3 | 3.4 |
| heterotype base paper (Na) | 4.8 | 3.7 | 3.8 | 3.0 | 3.2 | 3.3 |
| heterotype base paper (K) | 4.8 | 3.7 | 3.6 | 3.1 | 3.2 | 3.4 |
| general wrapper (pearl-coating) | 4.9 | 3.7 | 3.6 | 3.0 | 3.0 | 3.4 |

Table 4 shows results of quantifying indicators directly relating to a sense of smoking, such as the amount of atomization and a degree of flavor when an aerosol generation device operates through tobacco to which the tobacco rod wrapper 240*c* coated with a thermal conductivity enhancement material described through Table 1 to Table 3 is applied. A thermal conductivity enhancement material is applied only to the tobacco rod wrapper 240*c* to check how well thermal energy is transferred to an aerosol generating substrate included in a tobacco rod, and a thin paper inner is applied to the final wrapper 24. In Table 4, a general wrapper (control plot) means a general wrapper to which no thermal conductivity enhancement material is applied, and is an experimental group for confirming effectiveness of the present disclosure. In Table 4, a general wrapper (Na) and a general wrapper (K) are general wrappers respectively coated with sodium citrate and potassium citrate by 2%, and heterotype base paper (Na) and heterotype base paper (K) are heterotype base paper respectively coated with sodium citrate and potassium citrate by 2%. A general wrapper (pearl coating) means an experimental group in which a specific thermal conductivity enhancement material excluding sodium citrate and potassium citrate is applied to a general wrapper in a pearl coating method.

In general, according to Table 4, it can be seen that better results are obtained for the amount of atomization, smoking intensity, and a degree of flavor while there is little difference between an experimental group to which a thermal conductivity enhancement material is applied and heat sensation of oral region compared to a general wrapper (control plot), and respective results are relatively calculated results by using a maximum of 9 points as a reference score. As described above, according to the present disclosure, a user who uses an externally heated aerosol generation device may be provided with the abundant amount of atomization and a satisfactory smoking impression by applying a thermal conductivity enhancement material to the tobacco rod wrapper 240*c* to increase a transfer rate of thermal energy of the heater 130 which is supplied to an aerosol generating substrate.

The result according to Table 4 is a result of applying the thermal conductivity enhancement material only to the tobacco rod wrapper 240*c*, and according to the embodiments, the thermal conductivity enhancement material may also be applied only to the final wrapper 240.

TABLE 5

| items | amount | heat sensation of oral region | heat sensation of main stream smoke | smoking intensity | irritation | degree of flavor |
|---|---|---|---|---|---|---|
| MFW (control plot) | 4.5 | 3.6 | 3.6 | 3.1 | 3.0 | 3.6 |
| MFW (Na) | 4.7 | 3.7 | 3.7 | 3.3 | 3.1 | 3.8 |
| MFW (K) | 4.8 | 3.7 | 3.7 | 3.4 | 3.1 | 3.7 |

Table 5 shows a numerical increase in smoking impression felt by a user and in the amount of atomization of an aerosol generated by an aerosol generation device when a thermal conductivity enhancement material is applied only to the final wrapper 240. In Table 5, the thermal conductivity enhancement material is applied only to the final wrapper 240, and a general porous wrapper is used as the tobacco rod wrapper 240*c* to check how well thermal energy is transferred to an aerosol generating substrate included in a tobacco rod. In Table 5, MFW (control plot) means MFW base paper to which no thermal conductivity enhancement material is applied, and is a comparative experimental group for confirming effectiveness of the present disclosure. In Table 5, MFW (Na) and MFW (K) means MFW base paper respectively coated with sodium citrate and potassium citrate by 2%.

According to Table 5, it can be seen that higher result values are obtained for the amount of atomization, smoking intensity, and a degree of flavor while the final wrapper 240 to which a thermal conductivity enhancement material is applied has little difference in heat sensation of oral region with a control plot to which the thermal conductivity enhancement material is not applied, Table 5 shows results relatively calculated by using a maximum of 9 points as a reference score as shown in Table 4. As described above, according to the present disclosure, a user who uses an externally heated aerosol generation device may be provided with the abundant amount of atomization and a satisfactory smoking impression by applying a thermal conductivity enhancement material to the final wrapper 240 to increase a transfer rate of thermal energy of the heater 130 which is supplied to an aerosol generating substrate.

In the present disclosure, it is obvious not only that a thermal conductivity enhancement material may be applied to either the tobacco rod wrapper 240*c* or the final wrapper 240 but also that the thermal conductivity enhancement material may be applied to both the tobacco rod wrapper 240*c* and the final wrapper 240, and a process of coating (pearl coating) base paper (general wrapper, heterotype base paper, MFW base paper) which becomes a base with the thermal conductivity enhancement material follows the above-described method.

As an optional embodiment, a thermal conductivity enhancement material may also be applied to the tobacco rod wrapper 240*c* and the final wrapper 240 through an internal addition method instead of a coating method. Among thermal conductivity enhancement materials, metal such as aluminum, copper, or iron, calcium carbonate, aluminum nitrate, and silicon carbide are internally added during a process of manufacturing the tobacco rod wrapper 240*c* and the final wrapper 240, and thus, thermal energy from the heater 130 may be better transferred to an aerosol generating substrate.

The present disclosure provides a cigarette in which an aerosol is generated from an aerosol generating substrate included in a tobacco rod (medium portion) through external heating, and an externally heated aerosol generation device for using the cigarette, wherein the cigarette includes a tobacco rod wrapper that is wrapped around a tobacco rod and a final wrapper that is collectively wrapped around the tobacco rod wrapped by the tobacco rod wrapper and elements (a cross tube, a (circular) tube, and a filter) other than the tobacco rod, and the tobacco rod wrapper and the final wrapper are manufactured by a method of coating or internally adding a thermal conductivity enhancement material such as metal, filler, and fiber.

When a user smokes through the externally heated aerosol generation device according to the present disclosure, there is an effect of transferring sufficient thermal energy of a heater to an aerosol generating substrate, and thus, the user may have more satisfactory smoking experience than when smoking using an externally heated aerosol generation device known in the past.

The embodiment according to the present disclosure described above may be implemented in a form of a computer program that may be executed by various configuration elements of a computer, and the computer program may be recorded in a computer-readable medium. In this case, the medium may include magnetic media such as a hard disk, a floppy disk, and a magnetic tape, optical recording media such as a CD-ROM and a DVD, a magneto-optical medium such as a floptical disk, and hardware devices, which are specially configured to store and execute program instructions, such as a read only memory (ROM), a random access memory (RAM), and a flash memory.

Furthermore, the computer program may be specially designed and configured for the present disclosure or may be known and usable to those skilled in the computer software field. For example, the computer program may include not only machine language codes generated by a compiler but also high-level language codes that may be executed by a computer by using an interpreter or the like.

The specific implementations described in the present disclosure are examples and do not limit the scope of the present disclosure in any way. For the sake of brief specification, descriptions of electronic configurations, control systems, software, and other functional aspects of the systems may be omitted. In addition, connection of lines or connection members between the configuration elements illustrated in the drawings exemplarily represent functional connections and/or physical or circuit connections, and may be represented as various functional connections, physical connections, or circuit connections that may be replaced or added, in an actual device. In addition, if there is no specific description on an element, such as "essential" or "importantly", the element may not be an essential configuration element for application of the present disclosure.

In the specification (especially in the claims) of the present disclosure, use of terms "above-described" or "described above" and used of a designating term similar thereto may correspond to both the singular and the plural. In addition, when a range is described in the present disclosure, the disclosure includes an invention to which an individual value involved in the range is applied (unless otherwise stated), and is the same that each individual value constituting the range is described in the detailed description of the disclosure. Finally, if there is no explicit or contradictory description on a sequence of steps constituting the method according to the present disclosure, the steps may be performed in a suitable sequence. The present disclosure is not limited to the description sequence of the steps. Use of all examples or illustrative terms (for example, etc., and so on) in the present disclosure is merely for describing the present disclosure in detail, and the scope of the present disclosure is not limited by the above-described examples or illustrative terms, unless limited by the claims. In addition, those skilled in the art will recognize that various modifications, combinations, and changes may be configured according to design conditions and factors within the scope of the appended claims or equivalents thereof.

INDUSTRIAL APPLICABILITY

An embodiment of the present disclosure may be used to manufacture a next-generation electronic cigarette that provides convenience and a consistent sense of smoking to a user, and a cigarette of the electronic cigarette.

The invention claimed is:

1. A cigarette that generates an aerosol from a medium, the cigarette comprising:

a medium portion that includes the medium, a medium portion wrapper wrapped around the medium portion; and an outer cover that is collectively wrapped around the medium portion, wrapped by the medium portion wrapper, and elements other than the medium portion, wherein the medium portion wrapper is coated with a first thermal conductive enhancement material or includes a first internally added thermal conductive enhancement material, and wherein the medium portion wrapper is coated with the first thermal conductive enhancement material after the medium portion wrapper is calendered, or the medium portion wrapper is a wrapper subjected to calendering after being coated with the first thermal conductive enhancement material.

2. The cigarette of claim 1, wherein the medium portion wrapper is coated with the first thermal conductive enhancement material, and the outer cover is coated with a second thermal conductive enhancement material.

3. The cigarette of claim 1, wherein the outer cover is base paper coated with a second thermal conductive enhancement material.

4. The cigarette of claim 1, wherein the medium portion wrapper is coated with the first thermal conductive enhancement material after the medium portion wrapper is calendered.

5. The cigarette of claim 4, wherein the first thermal conductive enhancement material is aluminum foil.

6. The cigarette of claim 1, wherein the medium portion wrapper is the wrapper subjected to calendering after being coated with the first thermal conductive enhancement material.

7. The cigarette of claim 6, wherein the first thermal conductive enhancement material is any one from among sodium citrate and potassium citrate.

8. The cigarette of claim 1, wherein the medium portion wrapper is obtained by changing at least one from among tensile strength, smoothness, and stiffness of a normal porous wrapper.

9. An aerosol generation device comprising the cigarette according to claim 1.

10. The cigarette of claim 1, wherein the medium is tobacco, the medium portion is a tobacco rod, and the medium portion wrapper is a tobacco rod wrapper.

11. The cigarette of claim 1, wherein a coating amount of the first thermal conductive enhancement material on the medium portion wrapper is 1.83% to 2.31% of a total weight of the medium portion wrapper.

* * * * *